United States Patent [19]

Dean

[11] Patent Number: 4,662,921

[45] Date of Patent: May 5, 1987

[54] ALUMINUM INHIBITION SYSTEM FOR WET ROCK WOOL INSULATION USED IN CRYOGENIC SYSTEMS

[75] Inventor: Sheldon W. Dean, Allentown, Pa.

[73] Assignee: Air Products and Chemicals, Inc., Allentown, Pa.

[21] Appl. No.: 823,164

[22] Filed: Jan. 27, 1986

[51] Int. Cl.[4] ..... F17C 1/00

[52] U.S. Cl. ..... 62/45; 62/78; 220/88 B

[58] Field of Search ..... 62/45, 78; 220/88 B, 220/426, 429

[56] References Cited

U.S. PATENT DOCUMENTS

| | | | |
|---|---|---|---|
| 2,650,478 | 9/1953 | Brown | 220/88 B |
| 2,783,195 | 2/1957 | Raynes et al. | 220/429 |
| 3,724,228 | 4/1973 | Sollami et al. | 220/426 |
| 3,830,078 | 8/1974 | Read | 62/78 |
| 4,250,714 | 2/1981 | Covy | 220/88 B |

*Primary Examiner*—Ronald C. Capossela

*Attorney, Agent, or Firm*—Willard Jones, II; James C. Simmons; E. Eugene Innis

[57] ABSTRACT

A method of drying rock wool, used to insulate cryogenic equipment such as a cold box, comprising evaporation with a $CO_2$ purge during the defrost cycle.

4 Claims, 1 Drawing Figure

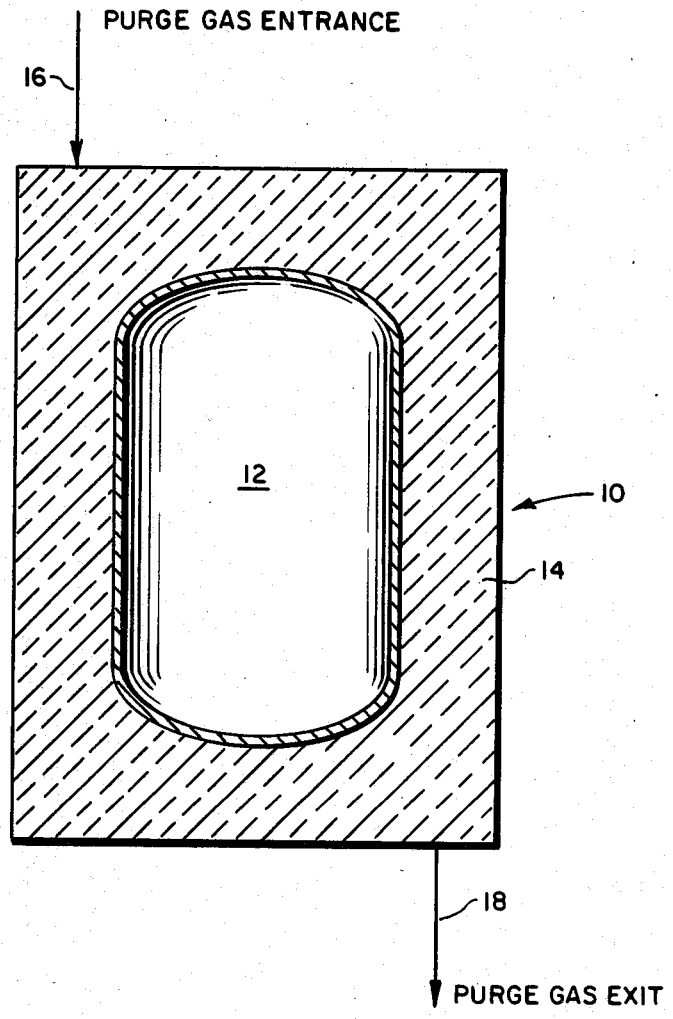
PURGE GAS ENTRANCE
16
12
10
14
18
PURGE GAS EXIT

ALUMINUM INHIBITION SYSTEM FOR WET ROCK WOOL INSULATION USED IN CRYOGENIC SYSTEMS

TECHNICAL FIELD

The present invention relates to a method for drying insulation during defrosting of cryogenic equipment.

BACKGROUND OF THE INVENTION

Insulation is a necessary component of any cryogenic system. Commercial cryogenic equipment, such as a cold box used to liquefy and separate air to produce product oxygen and nitrogen, is usually insulated with rock wool, perlite or similar inorganic fiber or powder product. Rock wool is a mineral wool made by blowing a jet of steam through molten rock or through slag. Often these insulation materials have excess sodium, calcium or other alkalai elements which produce a high pH solution when water is present.

Aluminum alloys, preferred materials of construction for cryogenic equipment, are strong, lightweight, readily welded and exhibit minimal brittle behavior at low temperatures. They are also inexpensive when compared with other metals possessing attractive cryogenic properties. However, unlike most other metals, aluminum alloys suffer catastrophic corrosion in high pH solutions because of the amphoteric nature of aluminum.

Over time, moisture enters the equipment and usually freezes, forming ice balls within the insulation. This poses no problem until a defrost cycle is undertaken. Defrosting is necessary to make changes or repairs on equipment. During defrosting, the liquid moisture will usually migrate to the aluminum surfaces and cause extensive corrosion damage to the equipment before starting up the equipment, especially if the equipment is being taken out of service for an extended period. Equipment repair is costly.

In order to minimize problems from corrosion due to defrosting, the cold box of the cryogenic system may be pressurized with dry nitrogen and the box kept sealed. During defrosting, dry nitrogen is passed through the box to evaporate the moisture before it has a chance to migrate to the surfaces. Purging of the rock wool with dry nitrogen is only partially effective. Alternatively, the rock wool may be removed from the cold box during the defrosting to minimize damage, but this is a very expensive process which is both lengthy and difficult. In spite of all of these measures, corrosion still occurs from ice balls formed in the insulation.

Another alternative is to use rock wool which is acid treated or has a lower pH when mixed with water. This approach is very expensive and limited by the availability of such products. Also, it is not useful in systems where untreated rock wool is already in place.

SUMMARY OF THE INVENTION

The present invention is a method for purging cryogenic cold boxes containing aluminum equipment and insulated with rock wool to prevent or minimize damage during the warm defrosting period by using a carbon dioxide ($CO_2$) inhibited nitrogen gas mixture or pure $CO_2$ gas. Addition of between 1% and 10% $CO_2$ to the nitrogen is effective without risk to steel and other metallic materials.

BRIEF SUMMARY OF THE DRAWING

The single FIGURE of the drawing is a cross-sectional schematic view of a cryogenic cold box containing an aluminum cryogenic vessel surrounded by rock wool insulation with an inlet and outlet for purge gas during defrosting cycles.

DETAILED DESCRIPTION OF THE INVENTION

The present invention, which minimizes corrosion of aluminum cryogenic equipment such as a cold box, is a modification of the current method of drying the rock wool insulation through evaporation with nitrogen during the defrost cycle. Ice balls normally form in the insulation of cryogenic equipment such as a cold box during operation. These ice balls melt during the defrosting and the water rapidly migrates to the aluminum alloy surfaces at a rate faster than the nitrogen gas used to purge the insulation can control corrosion. To prevent corrosion of the aluminum alloys, the present invention is a process for purging insulation such as that used in a cold box by adding $CO_2$ to the nitrogen purge gas or using pure $CO_2$ as the purge gas.

With reference to the single FIGURE of the drawing, a cross sectional schematic view of a cold box assembly 10 is shown. Cold box 10 contains aluminum cryogen vessel 12 which is surrounded by rock wool insulation 14. During defrosting cycles a carbon dioxide/nitrogen purge gas blend or a carbon dioxide purge gas would be introduced into cold box 10 via line 16, in order to abate corrosion of cryogenic vessel 12 from water from melted frost which has built up during operation of cold box 10. During defrosting cycles the carbon dioxide in the purge gas neutralizes the basic solution formed by the interaction of the water and rock wool insulation 14. The purge gas is then removed from cold box 10 via line 18.

Most metals, acting as a base in an acidic solution, produce metal oxides which protect the surface of the metal from further corrosion. Aluminum alloys, acting as an acid in a basic solution, produce water-soluble corrosion products. These products dissolve into the water solution thereby providing no protection for the aluminum surface. The use of $CO_2$ minimizes corrosion of aluminum alloys by reducing the pH of the equipment's atmosphere to the neutral range, thereby reducing the water solubility of the corrosion products.

The solubility of aluminum oxides and aluminum hydroxides increases by a factor of 10 with each pH unit above 5.0 at ambient temperature. The corrosion rate is roughly proportional to the solubility so that reducing the pH of a solution from 10 to 6 should reduce the corrosion by a factor of 10,000. In actual practice, the rate reductions are always less because the corrosion process itself tends to reduce the pH and so the rate is somewhat self limiting. However, initial high rates of corrosion do cause significant damage and the evaporation process which occurs later tends to aggravate the problem by continuing to concentrate the aggressively corrosive solution. When a $CO_2$ neutralization is effected, the corrosion rate of the metal surface is low initially and does not increase with hydroxide concentration. Aluminum alloys are resistant to aqueous $CO_2$ corrosion, therefore this procedure is safe in terms of damage potential from overtreatment with $CO_2$.

Tests were performed to compare corrosion rates using the nitrogen purge method and the $CO_2$-inhibited nitrogen purge method of the present invention.

EXAMPLE 1

The test procedure involved placing 20 grams of rock wool and one aluminum 6061 coupon in each of nine bottles containing 200 ml of water. The bottles were placed in a water bath at 100° F. and slowly bubbled with either $N_2$, 1% $CO_2$ in $N_2$, or 10% $CO_2$ in $N_2$. At the end of the test period, the coupons were removed, cleaned and reweighed. Corrosion rates were calculated based on weight loss. Data were collected for Examples with each atmosphere run in triplicate. Corrosion rates are measured in mils per year (MPY).

The corrosion rates for Example 1, shown in Table 1, were taken after 144 hours of treatment. These runs exhibited a definite lowering of solution pH by the $CO_2/N_2$ purge. The data in Table 1 show a trend toward lower corrosion rates with increasing $CO_2$ content in the purge.

TABLE 1

| Purge Gas | 100% $N_2$ | | | 1% $CO_2$ in $N_2$ | | | 10% $CO_2$ in $N_2$ | | |
|---|---|---|---|---|---|---|---|---|---|
| Run # | 1 | 2 | 3 | 7 | 8 | 9 | 4 | 5 | 6 |
| Corrosion Rate in MPY | 5.5 | 5.5 | 6.3 | 2.8 | 3.9 | 2.4 | 2.3 | 1.9 | 2.0 |

EXAMPLE 2

During the testing for Example 1, the test apparatus was unable to maintain complete contact between the aluminum coupon and the rock wool. Although a loose sample matrix was achieved, it was difficult to obtain thorough mixing of the gas with the aluminum-rock wool-water sample matrix. The gassing tubes frequently plugged up with rock wool deposits, thereby slowing or even stopping the gas flow. When the gas was bubbled at a high enough velocity to keep the gassing tubes clear, the gas was consumed at a far too rapid rate. At this rate of consumption, each gas cylinder was empty within a day. To alleviate these problems, fritted gas dispersion tubes were added to the test apparatus for the runs of Example 2. The fritted tubes were affected by plugging to an even greater degree than straight tubes and were quickly removed. The gassing was monitored as closely as possible and problems corrected as they arose. However, frequent interruptions in gassing did occur.

Corrosion rates for Example 2, which was run for 120 hours, are presented in Table 2. As in Example 1, Example 2 showed a definite lowering of solution pH by the $CO_2/N_2$ purge. Again there is a trend toward lower corrosion rates with increasing $CO_2$ content in the purge.

TABLE 2

| Purge Gas | 100% $N_2$ | | | 1% $CO_2$ in $N_2$ | | | 10% $CO_2$ in $N_2$ | | |
|---|---|---|---|---|---|---|---|---|---|
| Run # | 1 | 2 | 3 | 7 | 8 | 9 | 4 | 5 | 6 |
| Corrosion Rate in MPY | 22.4 | 20.2 | 22.8 | 12.2 | 17.2 | 15.2 | 11.3 | 13.1 | 9.1 |

EXAMPLE 3

A modified test procedure for Example 3 ensured closer contact between aluminum coupon and rock wool. Each aluminum coupon was tightly wrapped in a cotton "sack" containing approximately 20 grams of rock wool. The sack was then suspended in a beaker containing a layer of distilled water and a gassing tube extending into the vapor space above the water layer. The tip of each sack touched the water layer to form a wick which kept the rock wool damp. The water was replenished once a week, but was allowed to evaporate in the interim, thus allowing the rock wool to dry before being rewetted. Beakers were placed in a water bath at 100° F. and slowly bubbled with either $N_2$, 1% $CO_2$ in $N_2$, or 10% $CO_2$ in $N_2$. At the end of a three week test period, the coupons were removed, cleaned, and reweighed. Corrosion rates were calculated based on weight loss.

Test results utilizing the improved test method of Example 3 are shown in Table 3, which was run for 504 hours. Example 3 produced the same trend of decreasing corrosion rate with increasing $CO_2$ content in the purge. The $CO_2/N_2$ corrosion rates were significantly less than the $N_2$ corrosion rates.

TABLE 3

| Purge Gas | 100% $N_2$ | | | 1% $CO_2$ in $N_2$ | | | 10% $CO_2$ in $N_2$ | | |
|---|---|---|---|---|---|---|---|---|---|
| Run # | 1 | 2 | 3 | 4 | 5 | 6 | 7 | 8 | 9 |
| Corrosion Rate in MPY | 1.8 | 2.3 | 2.8 | 0.4 | 0.5 | 0.6 | 0.1 | <0.1 | <0.1 |

While the corrosion rates for the 100% nitrogen purge were not as high as anticipated by actual plant experience, the comparative reduction in corrosion rates with increasing $CO_2$ concentration are indicative of a similar reduction in the plant.

$CO_2$ neutralizes the alkali components of wet rock wool, for example calcium hydroxide, sodium hydroxide, magnesium hydroxide, and potassium hydroxide. $CO_2$ does not cause serious corrosion of aluminum alloys in itself. The use of $CO_2$ inhibition during defrost is a simple inexpensive solution to corrosion problems encountered during defrosting. The present invention does not require expensive rock wool removal during defrost operations. It is effective regardless of whether the rock wool is aggressive or not, may be used without any major modification to equipment, and is compatible with any insulation purge system.

I claim:

1. In a process for defrosting cryogenic equipment such as a cold box while preventing corrosion of external surfaces of an aluminum or aluminum alloy cryogenic vessel contained within said cold box and surrounded with rock wool insulation, by purging said insulated space during defrosting, the improvement comprising carrying out said purging with an atmosphere selected from the group of carbon dioxide and a mixture of carbon dioxide and nitrogen.

2. The process according to claim 1 wherein said atmosphere is carbon dioxide.

3. The process according to claim 1 wherein said atmosphere is a mixture of carbon dioxide and nitrogen.

4. The process according to claim 3 wherein said mixture comprises from about 1% to 10% carbon dioxide with the balance nitrogen.

* * * * *